US007686045B2

(12) United States Patent
Garcia et al.

(10) Patent No.: US 7,686,045 B2
(45) Date of Patent: Mar. 30, 2010

(54) APPARATUS AND METHOD FOR CREATING A FLAT SURFACE ON A WORKPIECE

(75) Inventors: Jaime E. Garcia, Jackson, TN (US); Craig A. Carroll, Milan, TN (US)

(73) Assignee: Black & Decker Inc., Newark, DE (US)

( * ) Notice: Subject to any disclaimer, the term of this patent is extended or adjusted under 35 U.S.C. 154(b) by 1294 days.

(21) Appl. No.: 11/180,762

(22) Filed: Jul. 13, 2005

(65) Prior Publication Data

US 2006/0137764 A1 Jun. 29, 2006

Related U.S. Application Data

(63) Continuation-in-part of application No. 11/021,486, filed on Dec. 23, 2004, now abandoned.

(51) Int. Cl.
*B27C 1/00* (2006.01)

(52) U.S. Cl. ..... 144/114.1; 144/117.1; 144/218; 144/286.1

(58) Field of Classification Search ..... 144/36, 144/38, 39, 42, 43, 1.1, 2.1, 3.1, 86, 87, 114.1, 144/117.1, 120, 129, 134.1, 231, 237, 287, 144/218, 286.1, 286.5; 83/425.2, 425.3, 83/508.3

See application file for complete search history.

(56) References Cited

U.S. PATENT DOCUMENTS

| | | | | |
|---|---|---|---|---|
| 146,632 | A * | 1/1874 | Allen | 83/425.3 |
| 422,333 | A * | 2/1890 | Brown | 144/242.1 |
| 517,336 | A * | 3/1894 | Frachmin | 144/89 |
| 2,771,921 | A * | 11/1956 | Ambelang | 144/117.1 |
| 4,025,219 | A | 5/1977 | Baumann et al. | |
| 4,817,693 | A * | 4/1989 | Schuler | 144/359 |
| 5,105,862 | A * | 4/1992 | Skinner et al. | 144/287 |
| 5,915,429 | A * | 6/1999 | Pelletier et al. | 144/39 |
| 6,058,993 | A * | 5/2000 | Albert et al. | 144/382 |
| 6,315,015 | B1 * | 11/2001 | Chang | 144/117.1 |

FOREIGN PATENT DOCUMENTS

| | | |
|---|---|---|
| DE | 14 53 193 A1 | 4/1970 |
| EP | 0 924 027 A2 | 6/1999 |

* cited by examiner

*Primary Examiner*—Shelley Self
(74) *Attorney, Agent, or Firm*—Michael Aronoff; Adan Ayala

(57) ABSTRACT

An apparatus and method for forming a flat surface on a workpiece. The apparatus includes a cutterhead, having a plurality of cutting member, configured for forming a plurality of grooves in a workpiece. The cutterhead may be disposed generally at the interface of substantially parallel offset first and a second supports in order to form a plurality of grooves defining a datum or reference plane which may be implemented to orientate the workpiece for forming a flat surface. A plurality of ridges or the like structures defining grooves are included in the second support or as an attachment to the second support in order to support the workpiece from the material forming the interior surface of the grooves so that the workpiece may be orientated with respect to the datum plane. In an additional aspect, a second cutterhead may be included for removing or forming a flat surface which is parallel to the datum plane.

8 Claims, 11 Drawing Sheets

APPARATUS AND METHOD FOR CREATING A FLAT SURFACE ON A WORKPIECE

CROSS REFERENCE

The present application claims priority as a Continuation-In-Part under 35 U.S.C. §120 to U.S. patent application Ser. No. 11/021,486, entitled: Apparatus and Method for Creating a Flat Surface on a Workpiece, filed on Dec. 23, 2004 now abandoned, which is hereby incorporated by reference in its entirety.

FIELD OF THE INVENTION

The present invention relates to the field of woodworking and particularly to an apparatus and method for generating a flat surface on a workpiece.

BACKGROUND OF THE INVENTION

Woodworkers often have to "true-up", or form lumber into flat surfaces, as part of a woodworking project. For example, most hardwood lumber or boards for cabinetry type purposes are typically sold in a relatively rough form. Due to varying transport and storage conditions, lumber may deform or include defects due to improper storage, variations in humidity, temperature variations, and the like. A hardwood board often is retailed with various defects or abnormalities which require correction prior to utilization or incorporation into the project. Defects may include cupped boards (a board which is not planar across its secondary axis (forms a bow across the width of the board)), a warp or twist (along either axis), and the like. Correction of these defects often requires a significant amount of skill/time in order to insure a proper finish such as a proper face joint between adjacent boards in cabinet panel.

When utilizing a jointer, the final condition of workpiece may be at least partly attributed to the user's skill at maintaining the proper down-pressure on the workpiece as it passes by the cutterhead. In particular, some level of skill may be required for the user to maintain uniform down pressure on an outfeed side of a jointer; thereby resulting in a uniform finish on the side of the workpiece being jointed. In some instances, mock defects may be created if a user stresses the workpiece during shaping operations. Excessive down-pressure on a bowed piece of lumber, during jointing operations, may cause the board to deform back into a bowed, or cupped shape, once pressure is relieved; thereby failing to properly finish the board. Further problems may include a workpiece being twisted or rocked between an infeed table and outfeed table during jointing operation. In the previous example, the resulting workpiece may include a non-uniform edge requiring further refining prior to utilization in the project.

Commonly, a jointer is utilized to generate a flat edge on a board (a minor side) prior to utilizing a planer to remove material from a primary face of a board, thus resulting in a board which has two flat sides. In practice, this goal may be difficult for a novice to achieve or may be time consuming. In some instances, a planer may fail to correct the defect and merely result in a nominal correction or a thinner board which still contains the defect. Typically, a planer includes a head which is disposed at a desired height above a table. A board to be planed is passed between the planer head (having an elongated cutter) and the table, thereby removing material.

In contrast, a jointer implements a cuttinghead which is disposed between parallel support surfaces to remove material. For example, a jointer may be utilized to flatten a board along its length to form a glue joint. Usually, depending on the hardness of the wood or workpiece, and the like, material may have to be removed in multiple passes (sequential operations) in order to remove a defect. Even when removing relatively small amounts of wood (i.e., a fraction of an inch), an operator may have to feed the material at a slow rate due to the feed pressure and power required to complete the operation. In the foregoing instance, a novice user may tend to force the workpiece thereby resulting in a rough edge. Furthermore, as most jointers are retailed with a 6" or 8" (six inch or eight inch) cutter, the effective capacity of these devices is limited. When jointing a large surface (relative to the machine capacity) numerous passes may be required in order to achieve the desired dimensions.

Therefore, it would be desirable to provide an apparatus and method for forming a flat surface on a workpiece which minimizes the amount of skill required by the operator to achieve a desired finished surface.

SUMMARY OF THE INVENTION

Accordingly, the present invention is directed to an apparatus for forming a flat surface on a workpiece via an intermediate datum plane. In an aspect of the invention, the apparatus includes a cutterhead having a plurality of cutting members configured for forming a plurality of grooves in a workpiece. In the present aspect, the cutterhead is disposed generally at the interface of substantially parallel offset first and a second supports in order to form a plurality of grooves defining a datum or reference plane. The intermediate grooves/datum plane may be implemented to orientate the workpiece for forming a flat surface referenced to the datum plane. A plurality of ridges or the like structures defining grooves are included in the second support or as an attachment to the second support in order to support the workpiece from the material forming the interior surface of the grooves so the workpiece may be orientated with respect to the datum plane.

In an additional aspect, a second cutterhead, such as a continuous cutterhead is further included in an apparatus for forming a flat surface. In an aspect, the second cutterhead is disposed in-line with the second support surface such that the second cutterhead is parallel to the datum plane supported by ridges included on the second support surface. The second cutterhead may be orientated in order for the workpiece to be supported by the floor of a plurality of grooves. Preferably, the second cutterhead is adjustably positionable toward/away from the second support surface to achieve a desired workpiece thickness.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. It is to be appreciated that corresponding reference numbers refer to generally corresponding structures throughout.

Figure 1A:
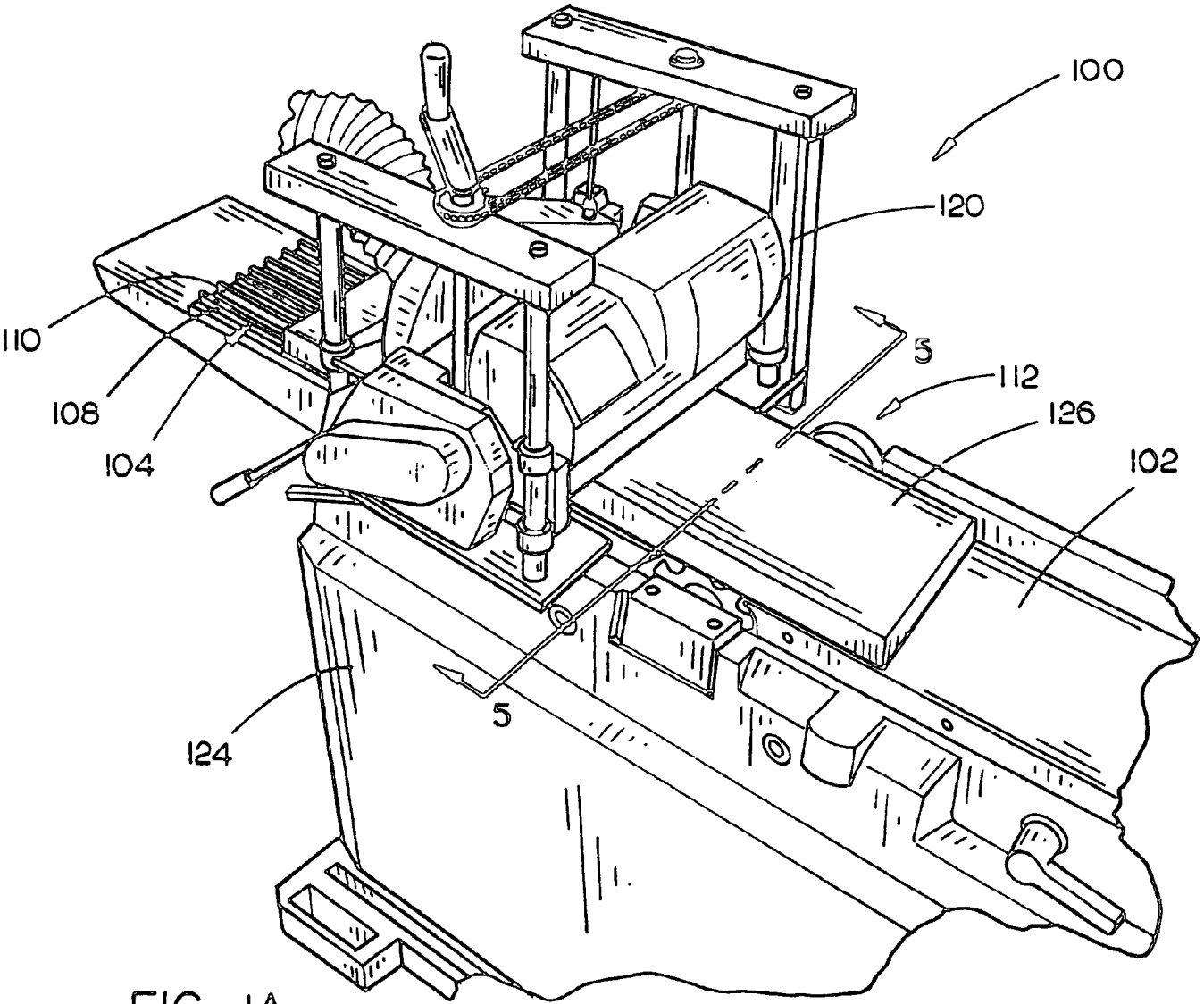
FIG. 1A is an isometric partial view of an apparatus for forming a flat surface in a workpiece in accordance with an aspect of the present invention.
Figure 1B:
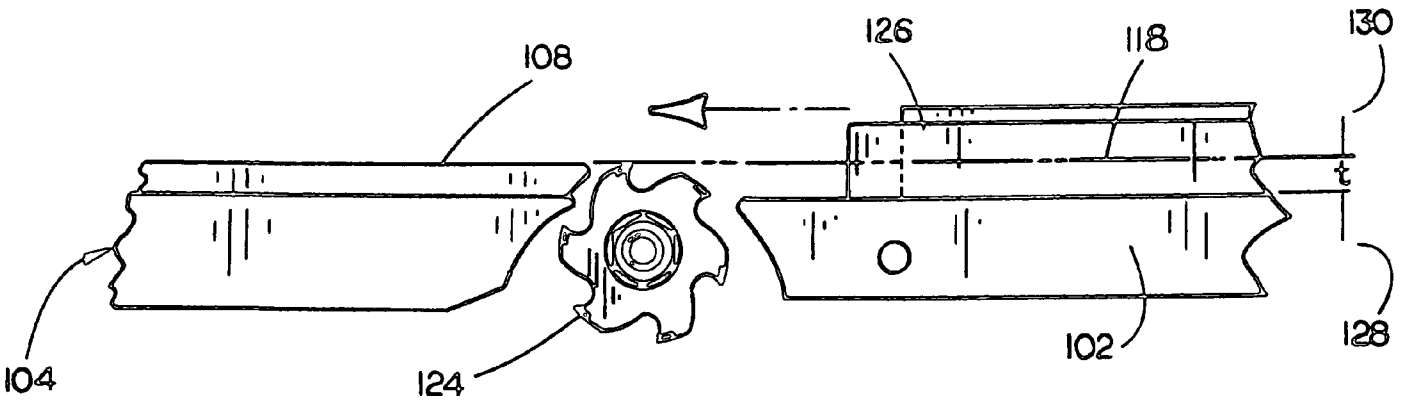
FIG. 1B is a partial side elevation view of the apparatus of FIG. 1A.
Figure 1C:
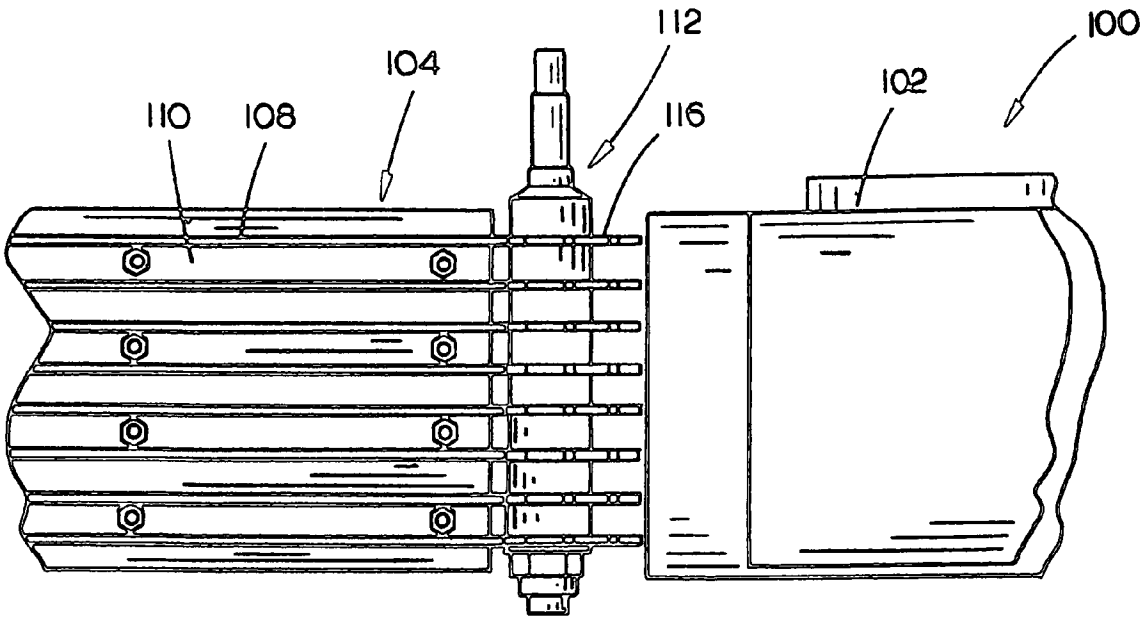
FIG. 1C is a partial top view of the apparatus of FIG. 1A.

Referring to FIGS. 1A-1C, a surfacing apparatus 100 in accordance with an embodiment of the present invention is disclosed. The apparatus 100 permits the formation of a plurality of grooves which correspond to an intermediate datum plane in a workpiece 126 such that a flat surface may be obtained in an efficient manner. For example, lumber such as a board or plank may have a variety of defects, or abnormalities, which make it unsuitable for its intended purpose (in a retailed condition). As noted previously, hardwood lumber often is retailed with these defects and it is the responsibility of the end user to correct the workpiece's deficiencies prior to use. In order for a user to implement the workpiece into a project, a flat surface is usually formed or material removed from the workpiece 126 until a desired flat surface is obtained. In most instances, four orthogonally orientated flat sides are desired.

An infeed, or first support 102, is included in the surfacing apparatus 100. The various components of the apparatus 100 may be supported by and/or enclosed (at least partially) in a cabinet 124, a stand, include a base such that the apparatus is portable, or the like. A second support, or outfeed support 104, is further included in the apparatus 100. The second support 104 includes a plurality of ridges (one of the plurality is identified as 108) defining a plurality of grooves (one of the plurality is identified as 110), or the like. Those of skill in the art will appreciate that a ridged/grooved attachment, such as a ridged plate, may be secured to a generally flat base support in order to permit alternative utilization. In alternative embodiments, an outfeed support may be formed with integral ridge/grooves, or the like. Additionally, while the outfeed support is illustrated as fixed (in the present embodiment) the outfeed support may be adjustably positionable as well, in order to permit alternative utilization of the surfacing apparatus 100, permit efficient depth of cut adjustment, and the like. For instance, the ridged/grooved surface may be formed of a plate of material having a low coefficient of friction, i.e., a rigid plastic, (in comparison to a polished steel or cast iron) to allow for easy manipulation of a workpiece, simplified manufacture/replacement, and the like. In the present embodiment, the first support 102 is adjustable, or may be variously positioned, with respect to the outfeed support 104. Preferably, during grooving operation, the first and the second supports are arranged in a parallel and offset fashion. In an advantageous example, an infeed support is constructed to index between a grooving position wherein the infeed support 102 is disposed at a first elevation 128 which is offset from the second support 104 and a surfacing position 130 wherein the infeed support is substantially equal in elevation to the outfeed support ridges 108. During utilization the infeed support may be disposed at an elevation so the difference between the infeed support elevation and the elevation of the outfeed support ridges corresponds to the thickness "t" (i.e., the distance between a grooving position and a surfacing position) or distance sufficient to remove at least one defect from the workpiece 126. Preferably, an indexing system is configured to permit adjustment between a pre-selected grooving position 128 and a surfacing position 130. For example, an indexed adjuster may allow for repeatable metered positioning between a pre-selected grooving position, e.g. a ⅝" (five eighths inch) offset, and the surfacing position wherein the infeed support is substantially equal in elevation to the top, or exterior portion, of the ridges included on the outfeed support. Suitable index systems include cam adjusters, rack and pinion systems, and the like for providing quick indexing to a surfacing position. Adjustable positioning may be accomplished by a threaded adjuster, gear systems or the like for varying the height for a particular workpiece. In other embodiments, an adjustable system, a combination indexed adjustment system and a variable adjustable system, or the like may be utilized as desired for proving variably adjustable positioning, or indexed positioning. If, for example, a board is cupped to ½" (one-half inch) the difference in elevation between the infeed support 102 and the outfeed support 104 may be set to ½" (one-half inch) or greater to ensure the cupped portion is removed, prevent the cupped portion from contacting the bottom of the grooves 310 included on the outfeed support 304 (i.e., hanging-up). Those of skill in the art will appreciate that a cutterhead forming grooves may reduce the amount of feed pressure as well as the power required in comparison to a cutterhead having a continuous blade of similar size for a similar workpiece.

As may be best observed in FIG. 1B, the infeed support 102 may be positioned at a first elevation 128 which is below or less than the outfeed support 104, when the apparatus is orientated as observed in FIG. 1A. In the present example, the outfeed support ridges (the furthest exterior portion of the rib) 108 are disposed at a second position or elevation 130 which is substantially parallel to a plane encompassing the infeed support 102.

In an addition embodiment, a first cutterhead is adjustable. For instance, a first cutterhead is adjustably mounted to allow for the cutterhead to slide or move below the elevation of the first support and/or second support to a remote position when not in use. In the foregoing manner, inadvertent contact with the cutterhead is prevented/minimized. Those of skill in the art will appreciate that a variety of mechanical positioning assemblies may be utilized to position a cutterhead between an engaging position (such as when grooving) and a remote position wherein the cutterhead is positioned to prevent contact. It is the intention of this disclosure to encompass and include such variation. Alternatively, the first support may be fixed while the cutterhead and second support are variable. For example, the first cutterhead and second support are configured to move substantially in unison or to achieve substantially the same relative elevations with respect to each other (the first cutterhead and second support) and to the first support. For instance, the second support and the first cutterhead may be configured so the periphery of the first cutterhead (i.e., the tooth) is positioned substantially equal to the furthest exterior portion of the ridges 108 included on the second support. Those of skill in the art will appreciate that the periphery of the cutterhead may extend slightly beyond the outer portion of the ridge so as minimize binding, or hang-up, of the leading edge of the board on the second support. In further embodiments, the ridges are tapered towards the first cutterhead to prevent the leading edge of the board from hanging-up or catching as the front end of a board comes in contact with the ridges. Additionally, the foregoing configuration may permit an infeed support (having a longer support surface toward/away from the cutterhead) to remain fixed thereby minimizing misalignment of the infeed support and thus the workpiece with respect to the first cutterhead.

Figure 2A:
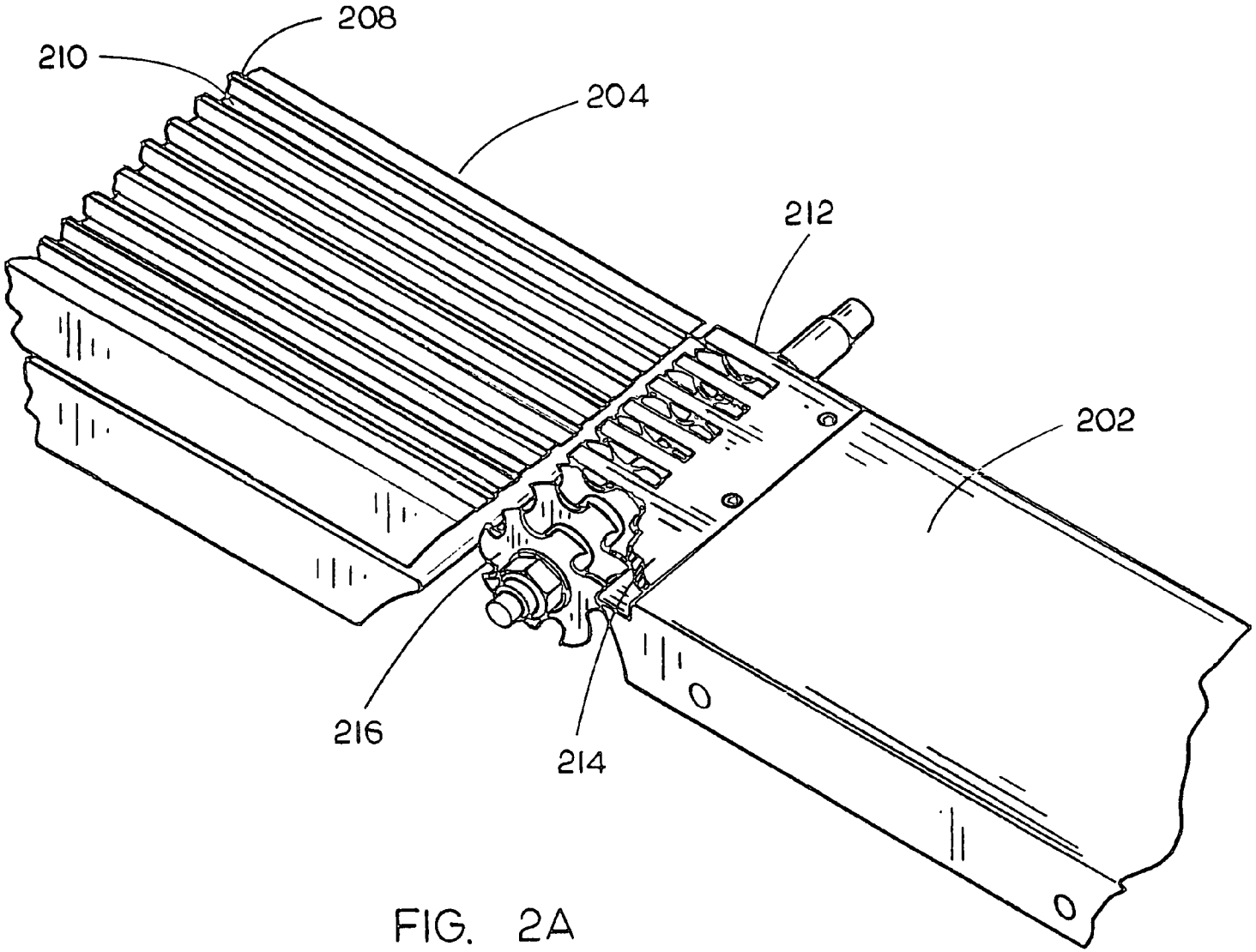
FIG. 2A is a partial isometric view of an apparatus for forming a flat surface in a workpiece.

Referring to FIG. 2A, a first cutterhead 212 is disposed or positioned generally at the interface of the infeed and outfeed supports 202 and 204, respectively. Those of skill in the art will appreciate that the first support 202 may include a separate extension 214, or be formed with an extension portion such as a minimum clearance extension for supporting a workpiece adjacent a first cutterhead 212. A minimum clearance extension 214 may provide near continuous support for the workpiece throughout surfacing operation thereby minimizing in-feed snipe. Snipe is a deeper cut into the trailing end of a workpiece which may be caused as the workpiece leaves contact with the infeed support when the outfeed support is set lower in relation to the cutterhead than in comparison to an idealized outfeed support/cutterhead alignment. For instance, the first cutterhead 212 is generally cylindrical and includes a plurality of cutting members (one is indicated as 216) constructed for forming a plurality of grooves in a workpiece wherein the cutting member at least partially extends through a minimum clearance support 214. In the present embodiment, the main axis of the first cutterhead 212 is orientated perpendicular to the infeed and outfeed supports. For example, a cutting member may be ½" (one-half inch) wide and be space apart so as to form a series of spaced apart grooves along the width of a workpiece (See generally FIG. 4A). Those of skill in the art will appreciate that individual cutting members may be a unitary cutterhead or may be (individually) removable in order to permit replacement, allow dimensional (e.g., radial dimension, thickness) changes or variation, and the like. If separate cutting members are implemented, a mechanical interconnect such as a keyway, a spline extension, or the like for mechanically fixing the cutting member(s) to a main member of the cutterhead may be implemented. In the present embodiment, a drive assembly is utilized to provide mechanical energy from a dedicated motor to the cutterhead in order to rotate the cutterhead. In further embodiments, a motor may power additional cutterhead apparatuses such as by utilizing a belt drive, a chain drive, or other suitable transmission, the motor may be directly connected to a cutterhead, or the like.

Figure 3A:
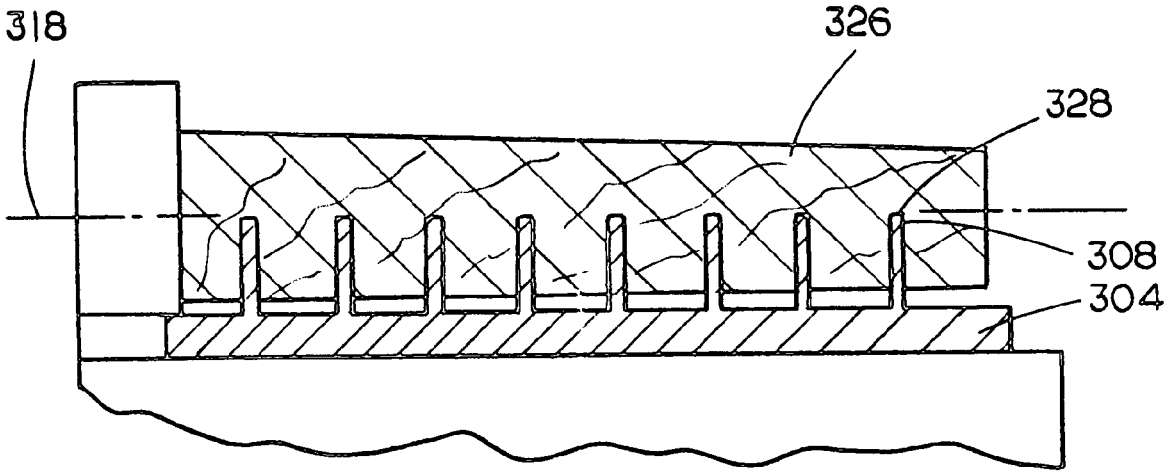
FIG. 3A is an end view of a workpiece of varying thickness being supported via ridges included in a second support.
Figure 3B:
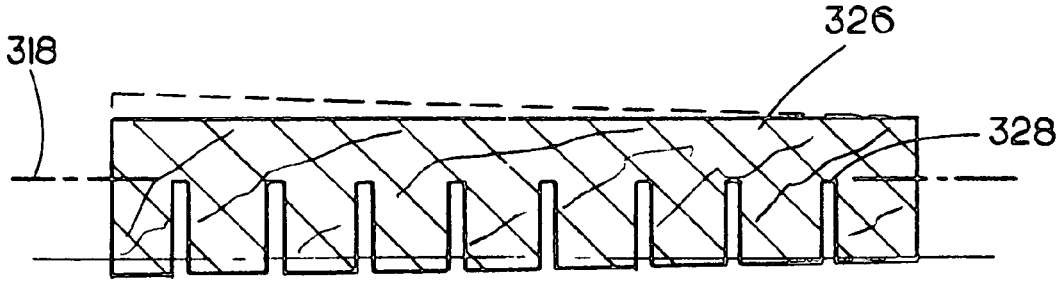
FIG. 3B is an end view of a workpiece having a twist, the workpiece having a plurality of grooves forming a datum plane.
Figure 4A:
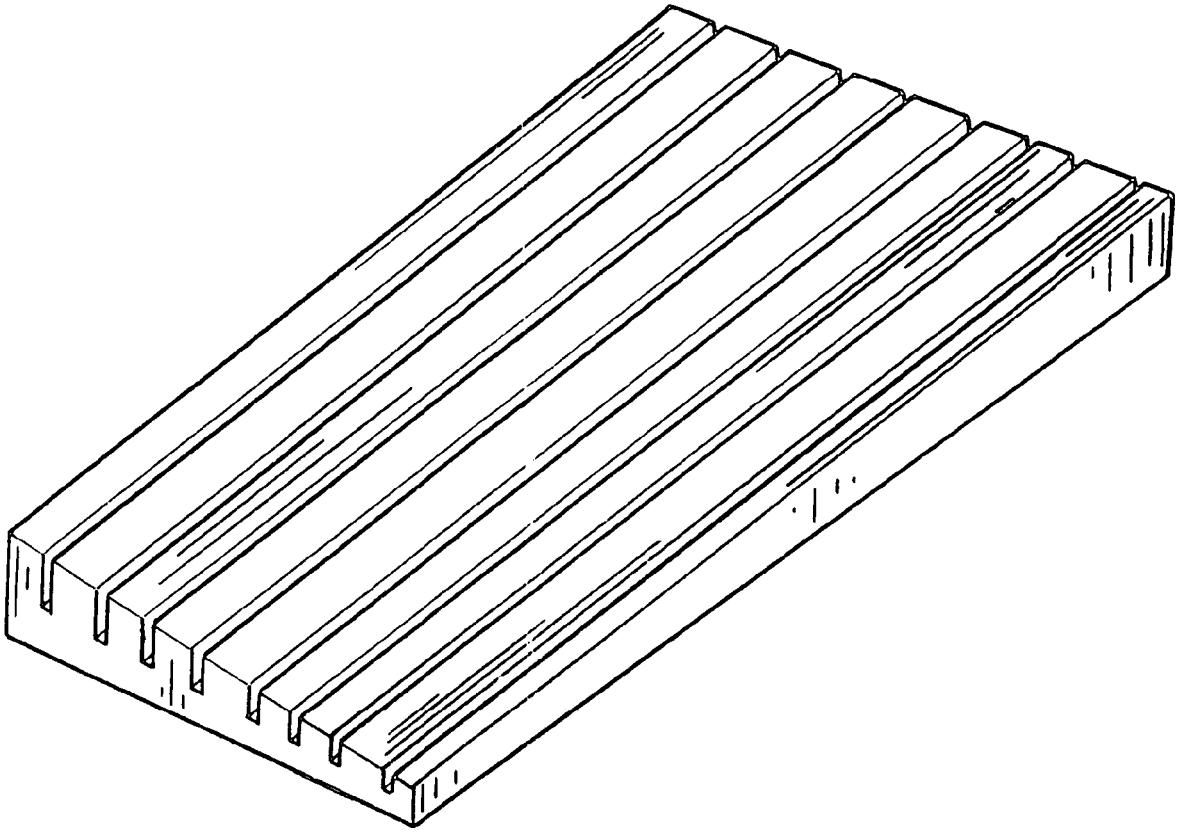
FIG. 4A is an isometric view of a workpiece having a varying thickness.
Figure 4B:
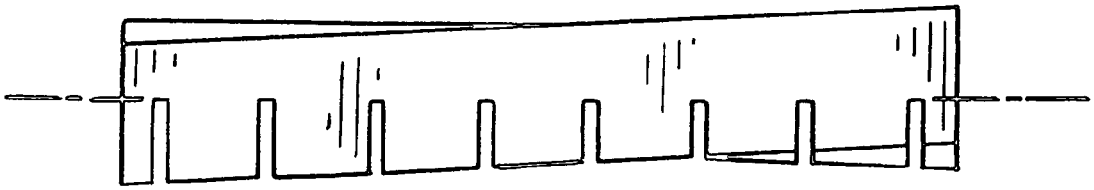
FIG. 4B is an end view of a workpiece having a warp or twist defect.

Referring now to FIG. 1B, in the present embodiment, the first cutterhead, including a plurality of cutting members, is disposed so that the periphery of the cutting members (i.e., the cutting tooth, such as a carbide tipped tooth) 124 are substantially equal to the plurality of ridges 108 included in the second support 104. For example, the cutting teeth included on a cutting member extend to a plane 118 encompassing the furthest most extension of the ridges 108 included in the second support 104. Referring to FIGS. 3A and 4A (indicating the resultant grooves in the workpiece), a workpiece may be supported on the second support ridges 308 by the workpiece material forming the floor of the groove channel 328 (i.e., the innermost surface of the groove, as may be generally observed in FIGS. 3A and 3B). In the foregoing manner, a workpiece is orientated relative to a datum plane 318 which is defined by the floor 328 of the workpiece grooves. As may be observed in FIGS. 3A and 3B, supporting a workpiece by a datum plane (i.e., floor of the grooves) permits correction for a defect such as a variation in the thickness of a workpiece (FIG. 3A and FIG. 4A (indicating a grooved workpiece having varying thickness)), a warped board, i.e., non-planer (FIGS. 3B and 4B), or the like.

Figure 2B:
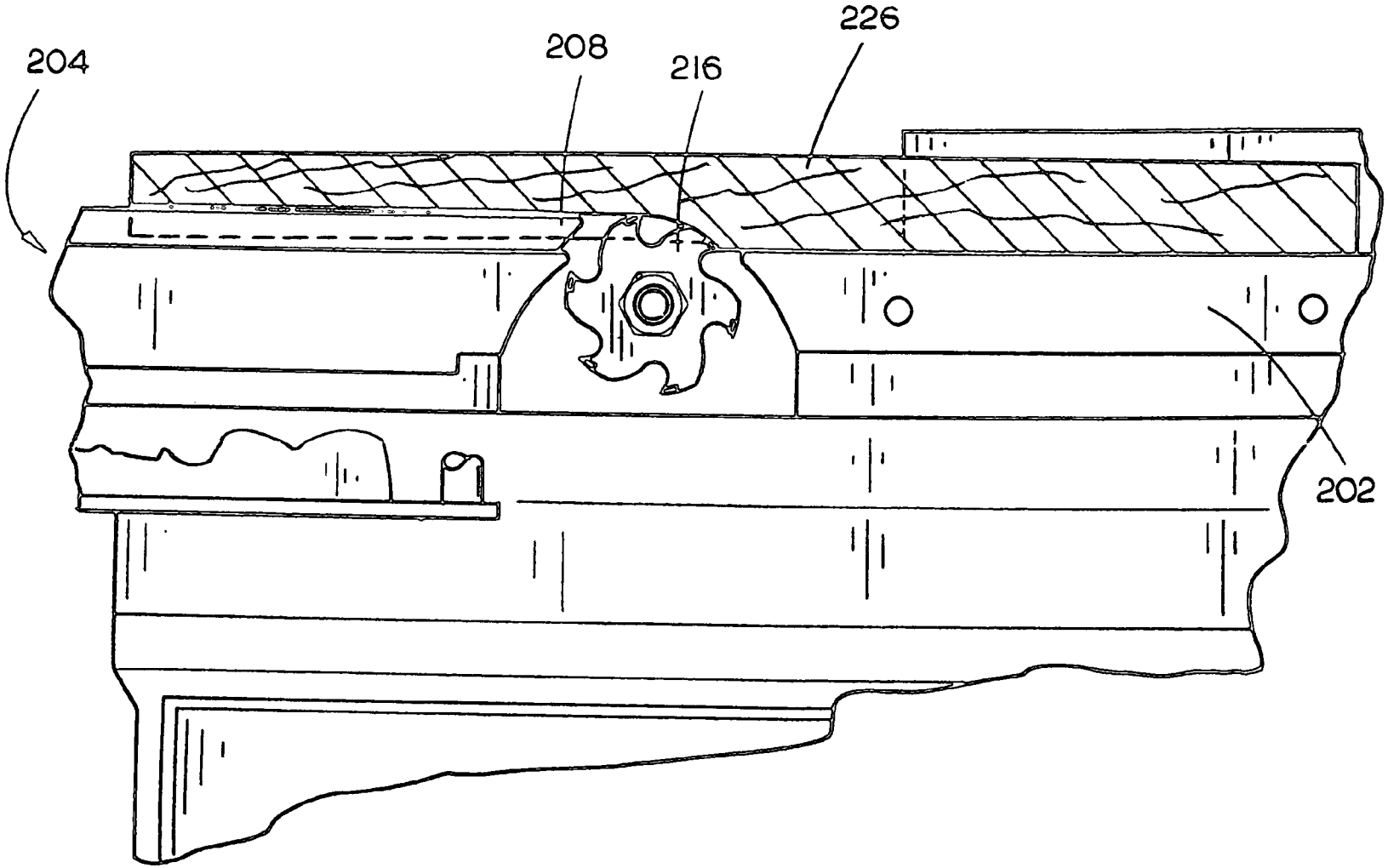
FIG. 2B is a partial side elevation view of an apparatus for forming a flat surface including a first cutterhead engaging with a workpiece.

Referring now to FIGS. 1C, 2A, and 2B, individual ridges 108 included in the plurality of ridges are (individually) aligned with corresponding (individual) cutting members 116. For example, ridges 108 are in-line with the cutting member so that the board rests, or is supported by, the material forming the innermost surface of the groove 328, formed in the workpiece (FIGS. 3A and 3B). In this manner, the workpiece may hang, or be supported by the ridges, while the outer surface of the board is free of the base of grooves. Additionally, ridges 108 are preferably of a width less than the width of a corresponding cutting member 116 so that a groove in a workpiece may slide on ridges included on the second support.

In an advantageous embodiment, an interlock such as a mechanical interlock or an electrical interlock is included in a surfacing apparatus to prevent operation or rotation of a first cutterhead when the first support is disposed in a surfacing position or when the first support surface is substantially equal to the ridges included in the second support. Alternatively, an interlock may prevent operation of the cutterhead when positioned in a non-cutting orientation such as when a non-grooving operation is being performed.

Figure 5:
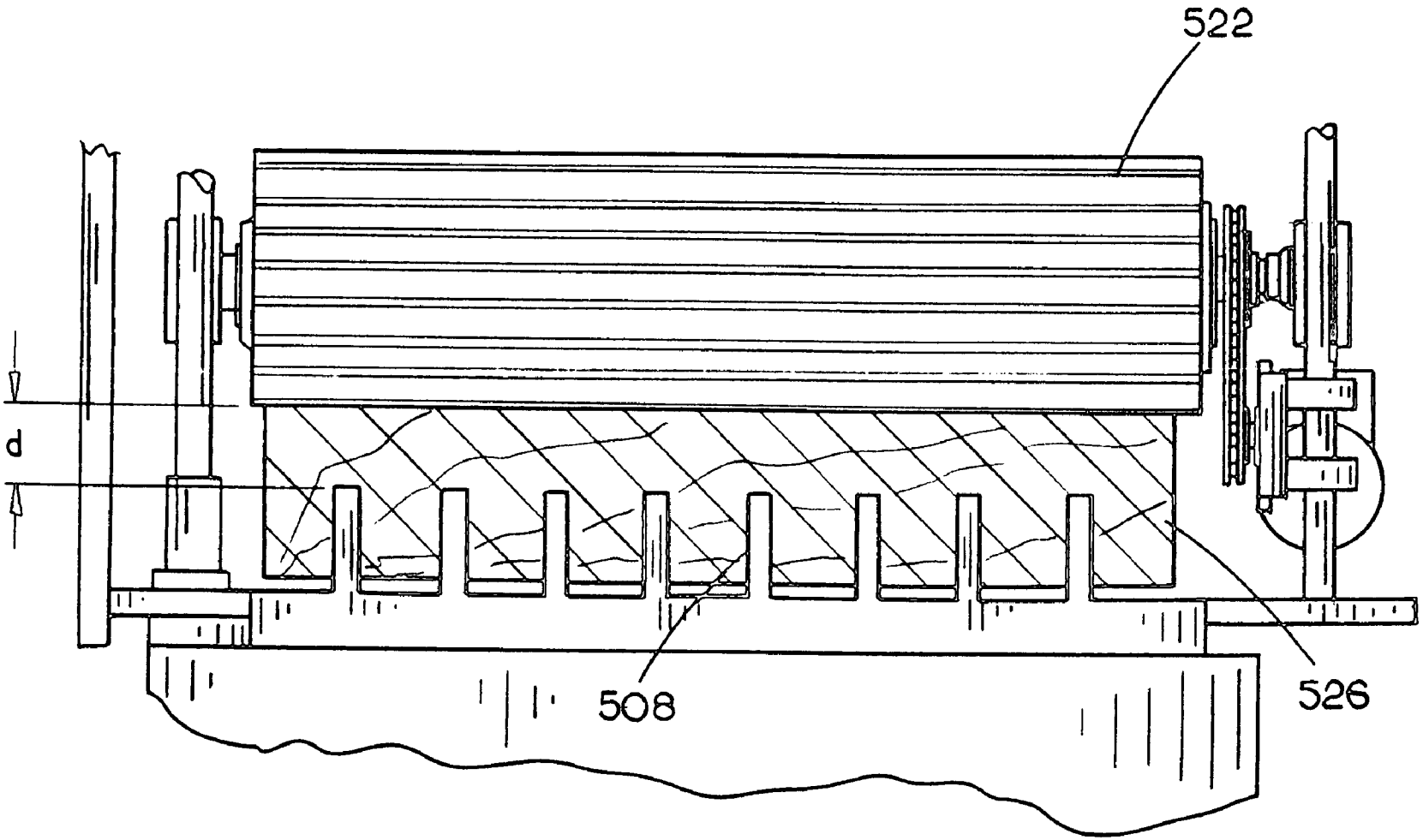
FIG. 5 is an end view of a workpiece including a plurality of grooves supported by support ridges.

Referring to FIGS. 1A and 5, in a further aspect of the present invention, a surfacing apparatus includes a second cutterhead assembly 120 having a second cutterhead. In the present embodiment, the second cutterhead is disposed substantially perpendicular to a second support 208 (i.e., the cutterhead is transverse to the second support 204/in-line with the second support) so as to remove material as a workpiece is passed between the cutterhead 522 and the support ridges 508. For instance, material may be removed by a continuous cutterhead positioned above the second support (when orientated as disclosed in FIG. 1A). Therefore, the second cutterhead 522 may positioned a distance "d" substantially equal to the desired board thickness away from second support ridges 508 and thus, a datum plane defined by a plurality of grooves formed in a workpiece 526 as discussed above. Those of skill in the art will appreciate that second cutterhead 522 may be disposed at a distance "d" greater than the desired board thickness away from the second or outfeed support to permit a second surfacing operation generating a smoother surface to be performed (i.e., performing a coarse removal operation and a finishing removal operation at a higher speed). Preferably, the second cutterhead is adjustably positionable. The second cutterhead 522 may be mounted on a rack and pinion mounting, a threaded mount, or the like so as to permit adjustable positioning of the cutterhead while ensuring secure positioning during operation (i.e., avoid skewing of the cutterhead with respect to the second support surface, preventing/minimizing snipe, movement of the cutterhead during utilization, and the like). Those of skill in the art will appreciate that the second cutterhead may include one or more removable knives, or blades, mounted to a generally cylindrical main member portion included in the cutterhead. In alternate embodiments, the cutterhead may include an integrated blade edge. Further, the second cutterhead assembly may be mounted to the second support if the second support is adjustably positionable so that the distance "d" does not have to be separately adjusted when the grooving depth is varied.

Figure 6:
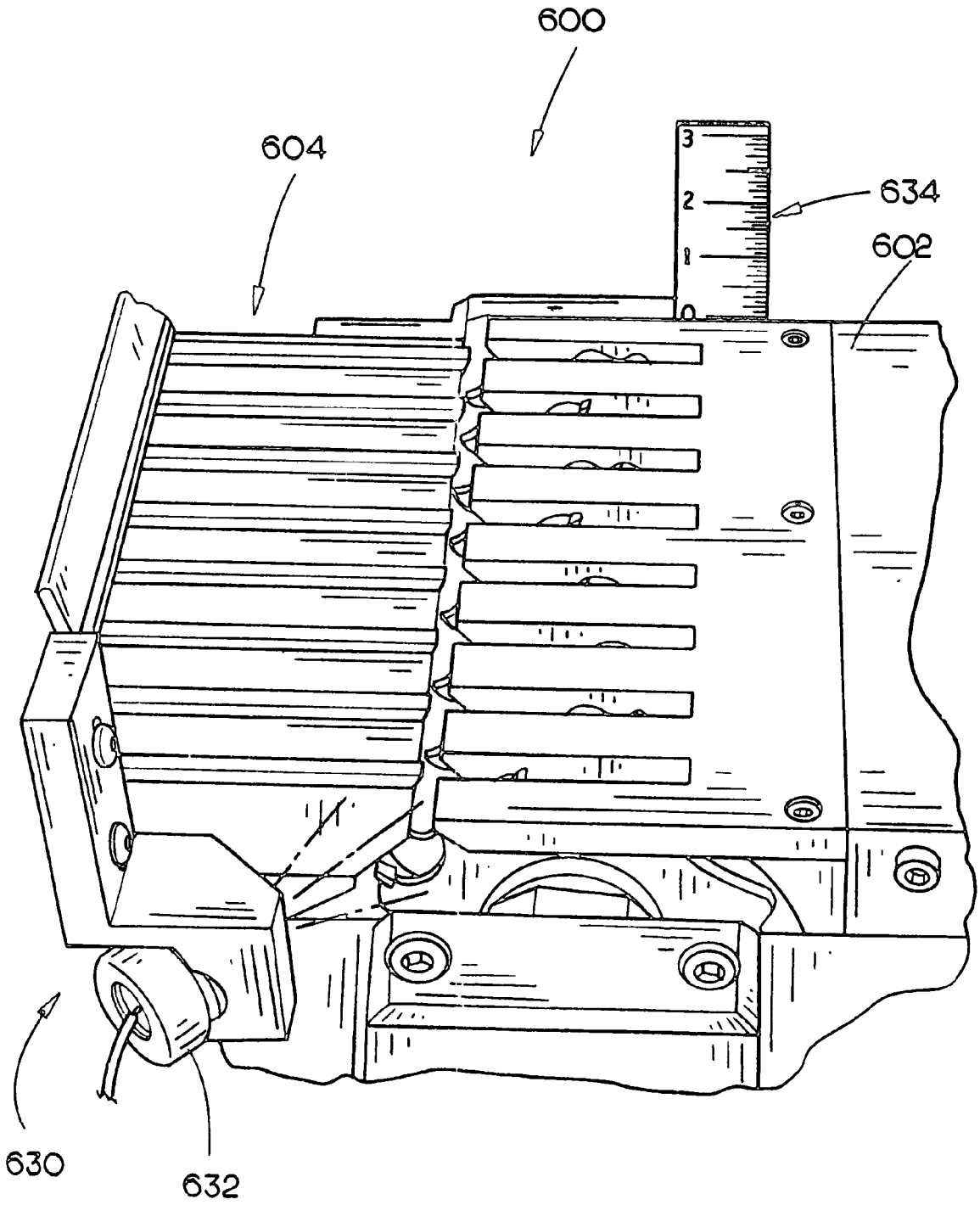
FIG. 6 is a partial isometric view of an apparatus for forming a flat surface including an optical alignment system.
Figure 8:
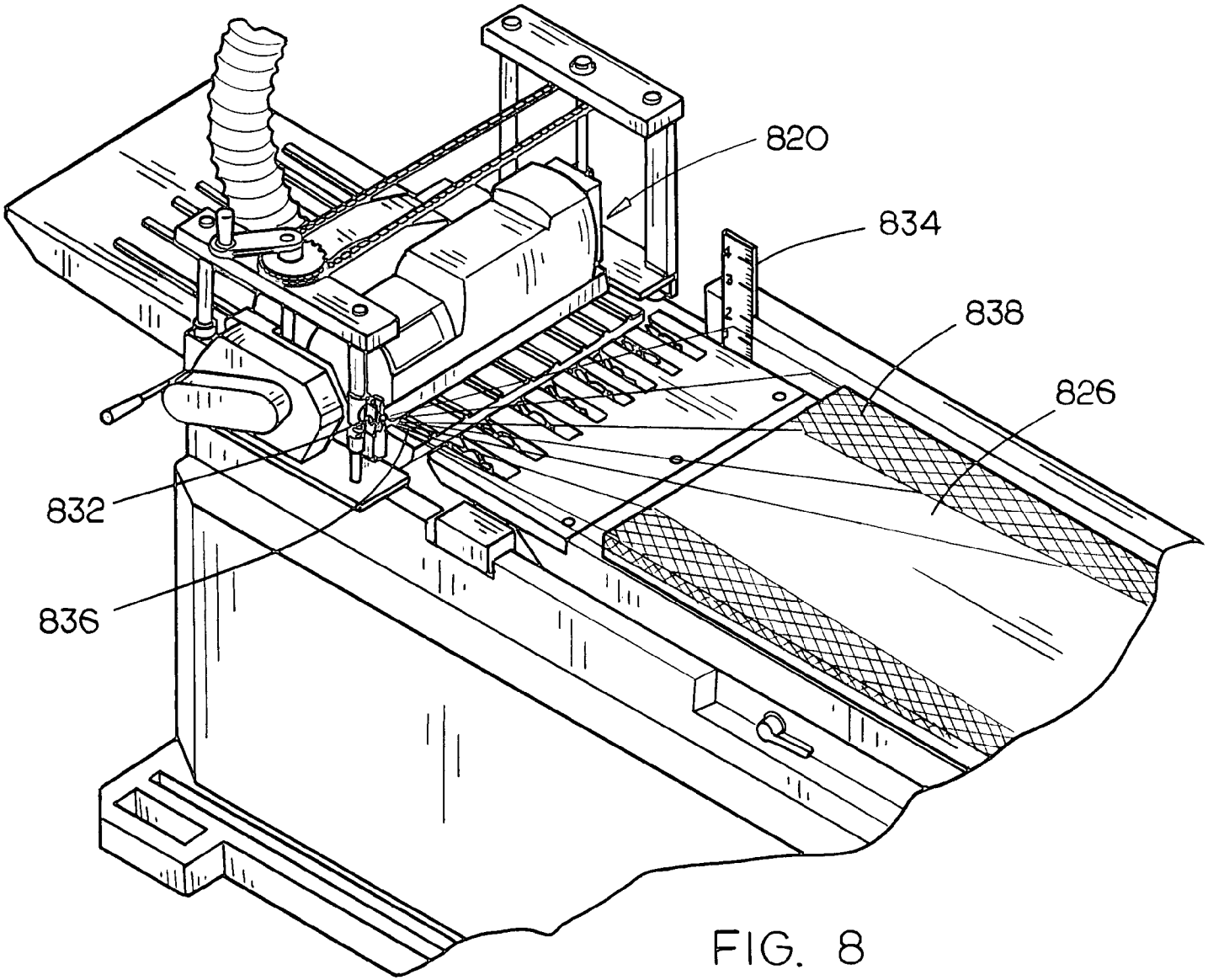
FIG. 8 is a partial isometric view of an apparatus for forming a flat surface including an optical alignment system associated with a second cutterhead assembly.

In further embodiments of the present invention, optical indicator systems may be included for providing a visual indicator or indicia for aiding configuration of the system. Referring now to FIG. 6, in further aspects of the invention, an optical indicator system 630 is included in a surfacing apparatus 600 for providing a visual indicia of the grooving depth. In the present embodiment, an optical source, included in the optical indicator system, such as a visible light source is associated with at least one of the first support or the second support so that a beam of visible light is projected on a scale 634, a target, or the like associated with the opposite support for indicating a height differential between the first and the second supports so the depth to which the grooves are being formed may be determined. In further embodiments, an optical indicator system may be associated with the second cutterhead assembly. When implemented in the foregoing manner, an optical source such as a laser emitting a beam or fan of light visible by a user may be aligned with outer periphery of the second cutterhead (at the cutting interface) so the beam of light may be projected on a scale, target, and/or at least partly on a workpiece in order for a user to determine if operation of the second cutterhead is sufficient to remove a particular defect or defects. See generally FIGS. 8 and 9. If, for example, a beam of light 836 (associated with the second cutterhead) is at least partially projected on the workpiece the projected beam may indicate whether a single pass of the workpiece through the second cutterhead assembly is sufficient to remove the defect. An optical indicator may additionally aid in indicating at what location along the thickness of the workpiece a flat surface may be obtained. For instance, when a cupped board is orientated with the concave surface directed away from the first support the projected light may be cast on the leading edge and the upper surface of the workpiece 838 (opposite the first support) and a scale 834 (associated with the first support) so the user may correlate the location of the useable portion of the workpiece 826 with the second cutterhead. In the foregoing instance, the projected beam may be cast on a leading edge of the workpiece, as well as, the scale so a user may determine the amount of offset which is required between the first and second supports and the first and second cutterheads. In this instance, an optical alignment system may be utilized in order for the user to ensure the second cutterhead is set to the correct position to remove the outer cupped portions of the board by observing the projected light. If, a cupped board is disposed with the convex side away from the first support surface the beam may be projected over the convex surface in order to ensure the second cutterhead removes the bowed portion. In an embodiment, a light emitting device such as a coherent light emitting device is utilized for projecting a beam of light in a plane encompassing the outer portion of the second cutterhead adjacent the second support (i.e., the cutting portion of the blade (the cutting interface) or blades near the second support). In this manner, a user is able to observe the expected interaction of the second cutterhead on the workpiece.

Figure 9:
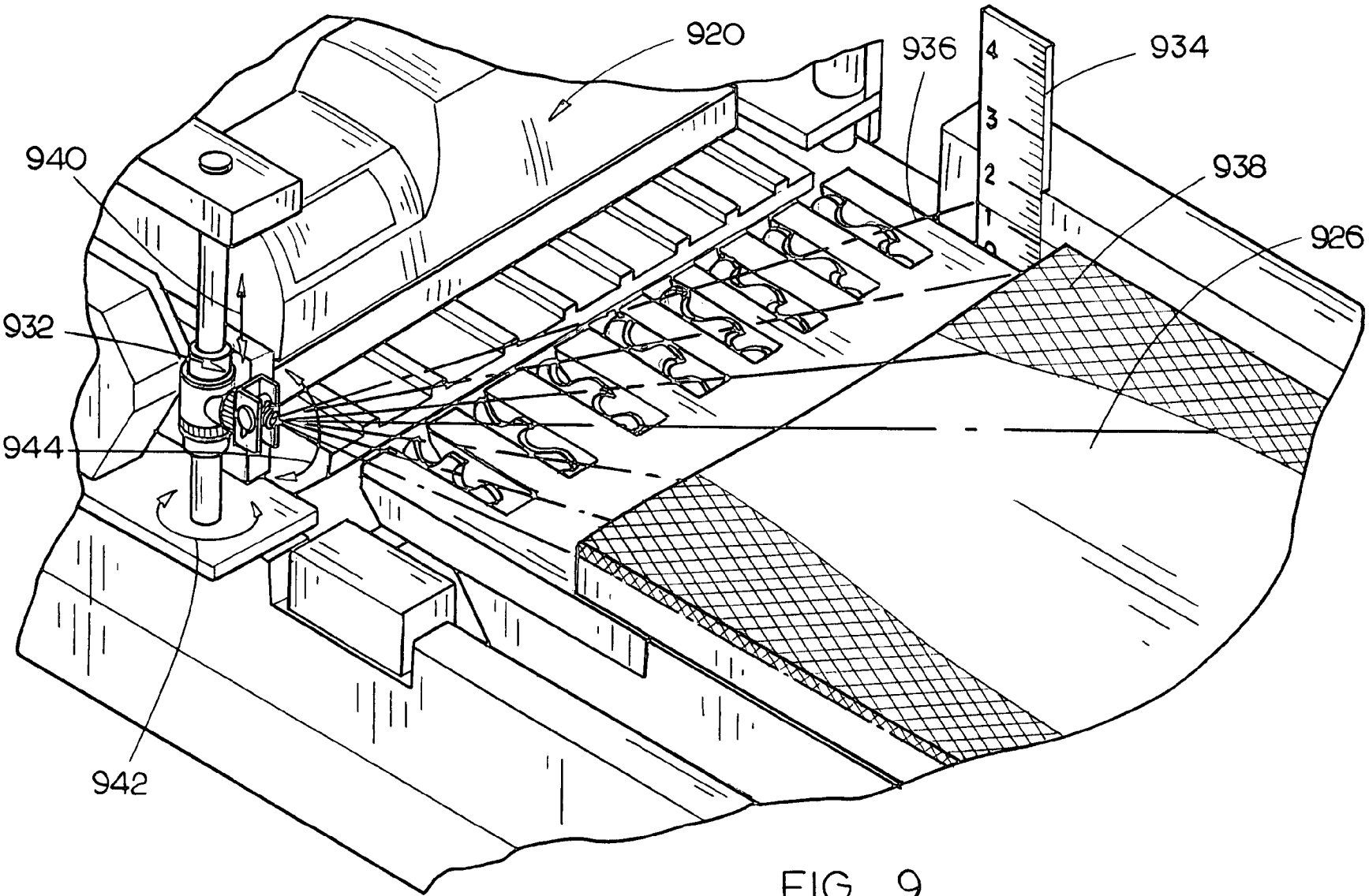
FIG. 9 is an enlarged partial isometric view of an apparatus for forming a flat surface including an optical alignment system associated with a second cutterhead assembly.

Referring now to FIG. 9, in the present embodiment, a mounting assembly 932 is coupled to a housing or the like associated with the second cutterhead assembly 920 in order to contain an optical indicator such as a helium neon laser, a diode laser, or the like for projecting a beam of visible light 936 towards a target and/or a workpiece 926 positioned on the first support surface. For example, the mounting is connected to a housing at least partially encompassing the second cutterhead. In the current embodiment, the mounting assembly is configured to allow for alignment/adjustment of the laser as desired. In the current embodiment, the mounting assembly is constructed to allow for orthogonal alignment/adjustment. For example, a laser is mounted in an inner housing which is adjustably coupled within the mounting. In the current embodiment, three degrees of freedom are provided. The mounting assembly may permit vertical alignment (generally towards/away from the second support (generally indicated by arrow 940)), rotate to allow for position or targeting of the fan or beam towards/away from the scale and/or the workpiece (i.e., generally within a horizontal plane encompassing the periphery of the cutterhead adjacent the second support 942 (as generally observed in FIG. 9), and to correct for skew 944 (should the beam or fan of light become non-parallel with respect to the first support and/or the second support). Height adjustment of the optical indicator, or vertical adjustment, may allow a user to adjust the laser based on the alignment of a knife or blade included in the cutterhead, the dimensions of knife/blade, and the like. Targeting of the optical source permits a user to aim the projected beam based on the workpiece dimensions, defects in the workpiece, and the like. Suitable devices include threaded rods or thumb screws, spring biased devices, adjustable mountings, pivotal mountings, and the like for permitting adjustment/alignment of the projected light. For example, a threaded thumbscrew is utilized to position the vertical alignment of the optical source while a pivotal inner mounting is utilized to aim the optical source to the desired position. Skew correction may be achieved by positioning a set screw and/or a spring, disposed on an opposite side of the set screw, perpendicular to the barrel of the optical source in order to align the projected light in the desired plane. In further embodiments, an optical source is adhesively secured by an in an inner mounting such as with an elastomeric material to prevent vibrations, inadvertent contact from dislodging the optical source.

In additional embodiments, a second optical system including an optical source such as a laser may be associated with the maximum cutting depth for the second cutterhead (for example being positioned above a laser associated with the cutting interface of the second cutterhead (as viewed in FIG. 9), or further away from the second support). In this manner, a user may be capable of determining how much material is to be removed by the cutterhead. For instance, a user may identify that while only ¼" (one quarter inch) of material will be removed adjacent the leading edge of the workpiece, a twist in the workpiece may cause ¾" (three quarters of an inch) to be removed adjacent the trailing edge. The inclusion of an optical source associated with the maximum depth of cut of the second cutterhead may allow a user to observe and configure the position of the second cutterhead appropriately for the specific working conditions. In the previous example, a user may select to remove less material by positioning the second cutterhead further away from the second support surface in order for the second cutterhead to operate efficiently, e.g, not causing the second cutterhead to remove too much material based on (for instance) the power of the cutterhead assembly, infeed and/or outfeed roller configuration, and the like.

Referring to FIG. 6, those of skill in the art will appreciate that a relative position of a first cutterhead/cutting members may be related as well. Suitable optical sources include laser such as a HeNe laser, a diode laser 632, a light emitting diode (LED), a fiber optic system coupled to a light source or the like. For example, a diode laser such as a laser projecting light in the red region of the spectrum is mounted to a support associated with a second or outfeed support 604 in order to direct a beam of light adjacent a workpiece which is supported on the first support 602 prior to grooving. In an exemplary method, a beam of light is passed adjacent the interface of the first and second supports to a target disposed on an opposite side of the first/second support. Preferably, the optical indicator is positioned so that the beam falls on a scale indicating the offset difference between the first/second support. If workpiece is below the beam (so the beam is not projected on the workpiece), the first support's elevation is adjusted until the beam is directly adjacent the side opposing the supported surface of the workpiece, i.e., slightly above the workpiece sufficient to allow at least a portion of the beam to pass. If the beam is projected on the workpiece, the first support may be lower (increase the offset between the first and second supports) until the beam of projected light passes by the surface of the workpiece opposite the support surface. In a present embodiment, an English measurement scale indicating inches is utilized to indicate the relevant offset/workpiece dimension (e.g., thickness). Those of skill in the art will appreciate a variety of projected beams of light may be implemented such as in the shape of an arrow, cross-hairs or the like for indicating support surface offset/workpiece dimension. In additional embodiments, an optical indicator may be associated with a second cutterhead assembly, or the like.

Figure 7:
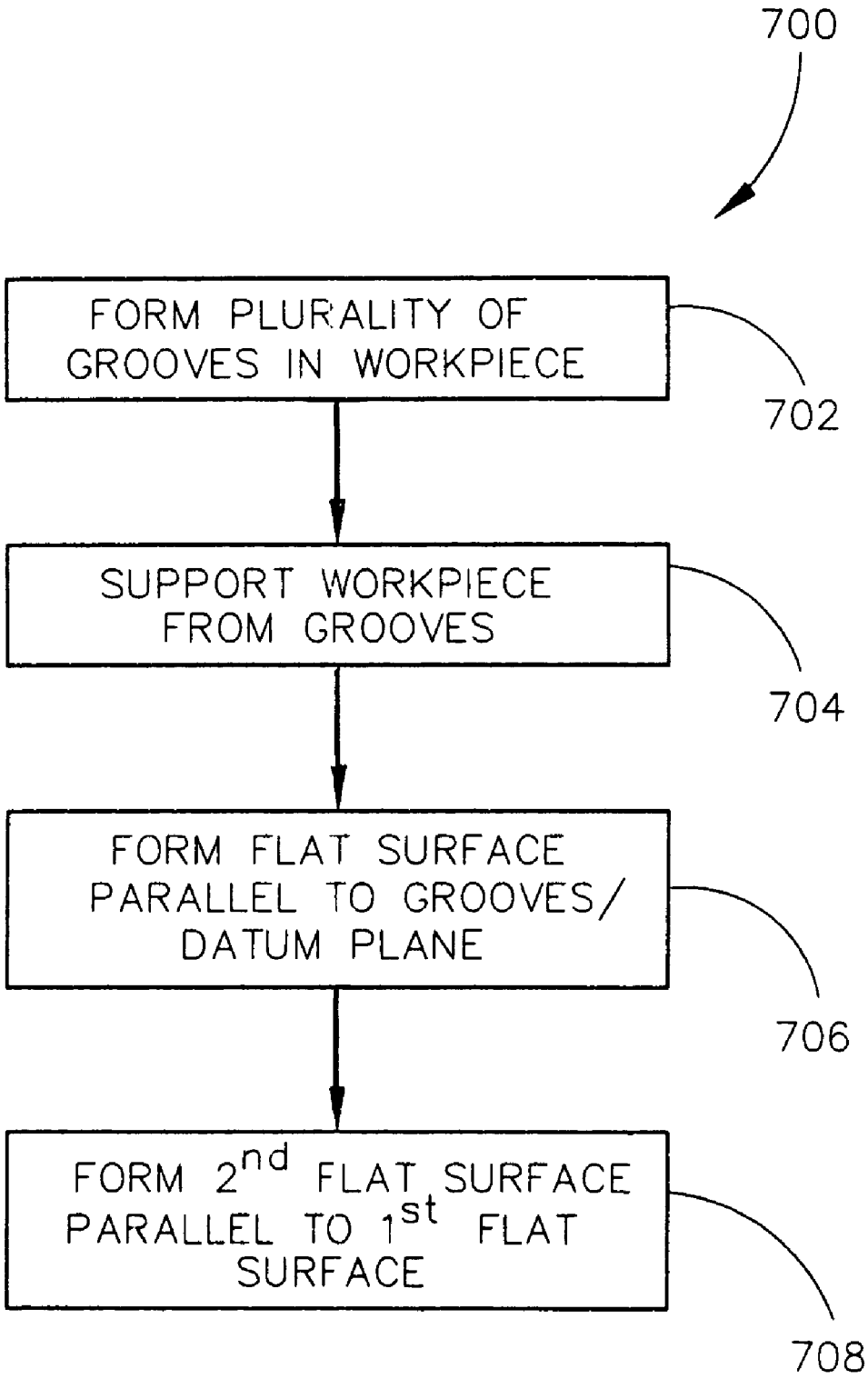
FIG. 7 is a flow diagram indicating an exemplary method of forming a flat surface in a workpiece.

Referring to FIG. 7, in a further aspect of the invention, a method of forming a flat surface on a workpiece 700 such as a board, or plank, is disclosed. Initially, a plurality of grooves is formed 702. For example, a cutterhead having a plurality of cutting members, is disposed at the interface of offset support surfaces in order to form a series of grooves defining a datum or intermediate reference plane. Preferably, the plurality of grooves is formed to a depth equal to at least one defect or abnormality to be removed from the workpiece. The workpiece, having a plurality of grooves, is supported 704 from the material forming the floor or interior surface of the groove. Supporting the workpiece from the grooves such as by a ridge support or the like structure permits the orientation of the workpiece with respect to the plurality of grooves 704, and thus the datum plane.

In a further step, a plane parallel to the datum plane/grooves is formed 706 while the workpiece is supported from the material forming the interior surface of the plurality of grooves. For example, a continuous cutter is utilized to remove material to the level of a plane corresponding to a desired thickness of the workpiece. Those of skill in the art will appreciate the desired thickness may be greater than the desired end thickness of the workpiece to allow for additional finishing/smoothing.

In a further optional step, a second flat surface is formed 708 parallel to the first flat surface formed in step 706. For instance, a workpiece may be turned over so the grooved side is exposed to a continuous cutterhead in order to remove material. In the previous example, the material may be removed equal to the depth of the grooves/datum plane or as desired. Implementing a grooving and subsequent continuous removal may reduce the respective power demand on the various cutterheads while permitting easy removal of workpiece defects.

If for example, only one major surface has a defect, subsequent to forming a plurality of grooves in step 702, a flat surface may be formed on the side of the workpiece including the grooves. Preferably, material is removed to a depth at least equal (substantially) to or greater than the depth of the plurality of grooves formed in step 702. For example, the remaining material forming the ridges (in the workpiece) is removed. As noted above, implementing a grooving and subsequent continuous material removal may reduce the respective power demand on the cutterheads while permitting easy removal of various defects. Material may be left on a flattened side to permit subsequent finishing such as a high-speed continuous material removal or to allow sanding (e.g., belt sanding, random orbit sanding or the like). Further, it is understood that the specific order or hierarchy of steps in the methods disclosed are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A surfacing apparatus, utilizing an intermediate datum surface formed in a workpiece to form a flat surface, comprising:

a first support, disposed at a first elevation, the first support being configured to support the workpiece to be surfaced;

a second support having a plurality of substantially longitudinal spaced ridges, disposed at a second elevation, the ridges forming a plurality of grooves in the second support;

a first cutterhead, disposed generally at the interface of the first support and the second support, the cutterhead including a plurality of cutting members, the cutting members being configured for forming a plurality of grooves in a workpiece corresponding to a datum plane, the datum plane being formed to a depth substantially equal to the second elevation; and a second cutterhead disposed in-line with the second support, the second cutterhead being disposed at a distance equal to the desired thickness of the workpiece from the second elevation, wherein the second cutterhead is operative to form a flat surface on the workpiece substantially parallel with the datum plane.

2. The surfacing apparatus, utilizing an intermediate datum surface formed in a workpiece to form a flat surface of claim 1, wherein the first support is configured to index between a grooving position wherein the first cutterhead is positioned so as to form a plurality of grooves associated with a desired datum plane and a surfacing position wherein the first support is substantially equal to a plane encompassing the plurality of second support ridges.

3. The surfacing apparatus, utilizing an intermediate datum surface formed in a workpiece to form a flat surface of claim

1, wherein the plurality of support ridges are substantially aligned with the first cutterhead cutting members.

4. The surfacing apparatus, utilizing an intermediate datum surface formed in a workpiece to form a flat surface of claim 1, wherein the second cutterhead is adjustably positionable with respect to the second support.

5. The surfacing apparatus, utilizing an intermediate datum surface formed in a workpiece to form a flat surface of claim 1, wherein the plurality of ridges included in the second support, are individually, of a thickness less than the thickness of a corresponding a cutting member included in the plurality of cutting members.

6. The surfacing apparatus, utilizing an intermediate datum surface formed in a workpiece to form a flat surface of claim 1, wherein the first cutterhead is arranged such that the plurality of cutting members are configured to extend through the first support.

7. The surfacing apparatus, utilizing an intermediate datum surface formed in a workpiece to form a flat surface of claim 1, further comprising an extension, connected to the first support, the extension being arranged to at least partially support a workpiece adjacent the first cutterhead.

8. The surfacing apparatus, utilizing an intermediate datum surface formed in a workpiece to form a flat surface of claim 1, further comprising an interlock for preventing operation of the first cutterhead when the first support is disposed in a surfacing position.

* * * * *